US005199594A

United States Patent [19]

Obara et al.

[11] Patent Number: 5,199,594

[45] Date of Patent: Apr. 6, 1993

[54] CONTAINER FOR RECOVERING A USED TREATING LIQUID

[75] Inventors: Kuniyasu Obara, Chiba; Yoshiaki Take; Akihiro Taguchi, both of Tokyo, all of Japan

[73] Assignee: Toppan Printing Co., Ltd., Tokyo, Japan

[21] Appl. No.: 492,405

[22] Filed: Mar. 8, 1990

Related U.S. Application Data

[63] Continuation of Ser. No. 169,020, Mar. 16, 1988.

[30] Foreign Application Priority Data

Sep. 26, 1985 [JP] Japan ..... 60-147043
Mar. 23, 1987 [JP] Japan ..... 62-42334[U]

[51] Int. Cl.[5] ..... B65D 87/16

[52] U.S. Cl. ..... 220/403; 383/39; 383/40

[58] Field of Search ..... 220/20, 22, 85 B, 403, 220/405; 383/38, 39, 40

[56] References Cited

U.S. PATENT DOCUMENTS 2,299,611 10/1942 Clark ..... 220/85 B
3,233,817 2/1966 Casadey ..... 220/465
3,330,439 7/1967 Moorman ..... 220/465
3,918,605 11/1975 Butler ..... 220/465
3,931,907 1/1976 Henle ..... 220/22
4,008,831 2/1977 Vidilles ..... 220/85 B
4,174,051 11/1979 Edwards ..... 220/465

FOREIGN PATENT DOCUMENTS 198424 7/1958 Austria ..... 220/20
0194871 9/1986 European Pat. Off. .
58-52065 8/1983 Japan .
WO85/03056 7/1985 PCT Int'l Appl. .
1018411 1/1966 United Kingdom ..... 220/85 B
2111939 7/1983 United Kingdom ..... 220/85 B

*Primary Examiner*—Joseph Man-Fu Moy
*Attorney, Agent, or Firm*—Bacon & Thomas

[57] ABSTRACT

A container is provided for recovering a used treating liquid, and is composed of an outer box and a flexible inner bag, the inner bag being held within the outer box and having a partition wall by means of which the interior thereof is divided into a treating-liquid storage chamber and a used-liquid storage chamber, the storage chambers each having an access port by way of which each is connected to an outer associated apparatus.

7 Claims, 2 Drawing Sheets

CONTAINER FOR RECOVERING A USED TREATING LIQUID

This application is a continuation of application Ser. No. 07/169,020, filed Mar. 16, 1988.

BACKGROUND OF THE INVENTION

1. Field of the Invention

The present invention relates to a container adapted to be used in association with a treating apparatus for, for example, treating a photosensitive material, in order to recover used treating liquid.

2. Explanation of the Prior Art

A container suitable for holding such a treating liquid is the so-called bag-in-box type, which has "pore-in" and "pore-out" (access) ports and is the form of an inner bag which is held within an outer box made of corrugated cardboard.

This type of container is set in the treating apparatus and holds a treating liquid to be used in the treating apparatus. The container is used as a cassette type and, when one treating liquid is to be replaced by another treating liquid, another container is required to recover used liquid. This requires an extra space for replacement and, moreover, a cumbersome operation for replacement.

With a view to eliminating such a cumbersome operation, a type of container has been proposed in Japanese Patent Disclosure (KOKAI) NO. 58-52065, which comprises a first flexible container unit for holding a treating liquid, and a second flexible container unit, which is located outside of the first flexible container unit, for recovering spent liquid, the each container unit being provided with access ports for connection to an associated apparatus.

However, since the aforementioned container is made up of two container units equipped with access ports, it is difficult to correctly connect charging and discharging tubes relative each other with the container set in the treating apparatus. Therefore, there is a risk that a connection error will occur between the charging and discharging tubes. Furthermore, it is not easy to assemble the first and second flexible container units within an outer box because one of the container units is provided separate from the other container unit.

A type of container can be formed which comprises an outer box and inner container units integrally held within the outer box, each inner container unit being divided by a partition wall into two chambers. Due to two access ports provided on each container unit, the pliability of the container unit is lost, particularly at those flange areas of the access ports where a fusion bond is effected. When the inner container units are held within the outer box, bends and creases are more likely to be formed on the inner container units, so that when they are subjected to vibrations during the transportation thereof pinholes are likely to be formed at these bend and creased portions.

SUMMARY OF THE INVENTION

It is accordingly the object of the present invention to provide a treating-liquid container which can recover a treating liquid which has become a spent liquid, which is properly set within an associated treating apparatus, has access ports which can be readily and positively connected to and disconnected from the container, and is less liable to produce pin-holes on the inner bag during transportation which would otherwise occur.

DETAILED DESCRIPTION OF THE PREFERRED EMBODIMENTS

The embodiments of the present invention will now be explained below, with reference to the accompanying drawings.

EMBODIMENT 1

Figure 1:
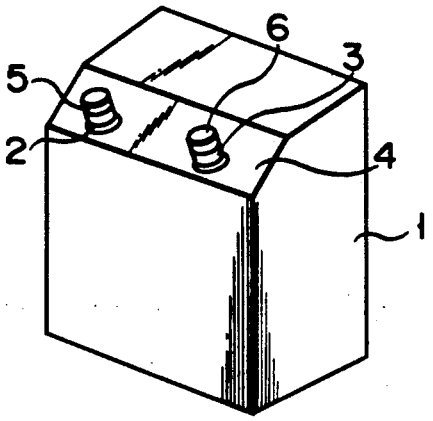
FIG. 1 is an explanatory view showing a treating-liquid container according to one embodiment of the present invention.
Figure 2:
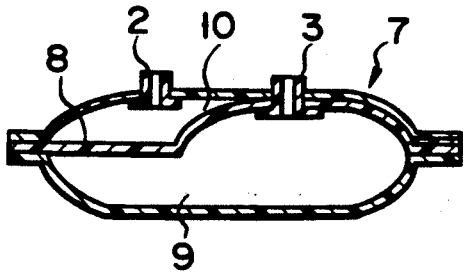
FIG. 2 is a cross-sectional view showing an inner bag of the container of FIG. 1.
Figure 3:
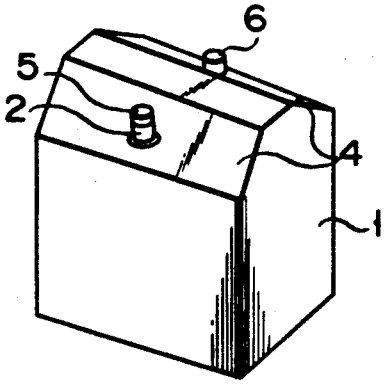
FIG. 3 is a view showing the outer appearance of a form of the container of FIG. 1.

FIG. 1 is a view showing the outer appearance of a treating-liquid container according to one embodiment of the present invention. Outer rectangular box 1 is made of a rigid material, such as a corrugated cardboard, and has fixing section 4 about 45°-inclined at one corner side with a pair of access ports 2, 3 each closed by a cover at fixing section 4 of box 1. Inner bag 7 is disposed within outer box 1 and is made of a plastics film section and a laminate section. As is shown in FIG. 2, bag 7 is formed as a flexible bag with treating-liquid storage chamber 9 and used-liquid storage chamber 10 defined therein by flexible partition wall 8. Access ports are different in size in the same direction and of such a type that they are fixed to the outer box.

Figure 4:
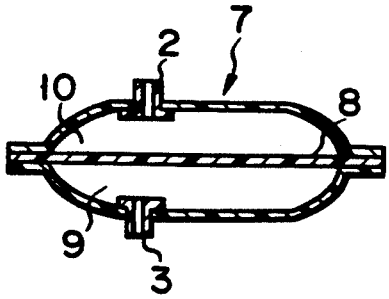
FIG. 4 is a cross-sectional view showing an inner bag of FIG. 3.

A pair of fixing sections 4, 4 may be formed, unlike the single fixing section of FIG. 1, on the corner sides in a symmetrical fashion, that is, with one of fixing sections 4 and 4 located on one corner side and the other on the opposed corner side of the box. In this case, access ports 2 and 3 are opened not in the same direction but in the opposed direction, as is shown in FIG. 4.

If access ports 2 and 3 of different size are used in combination with covers 5 and 6 of different color, they can readily and positively be connected to an associated treating apparatus. A choice of a different color or size well serves the purpose if the color or size is applied to one of access ports or to one of covers 5 and 6. An inner sealing member may be initially employed for sealing to an open end of port 2 if port 2 is used as a "pour-out" one. If, in this case, an associated connector is connected to port 2 at the time of use, it is possible to prevent the user's hands and garments from being fouled due to the deposition thereon of used liquid.

EMBODIMENT 2

Figure 5:
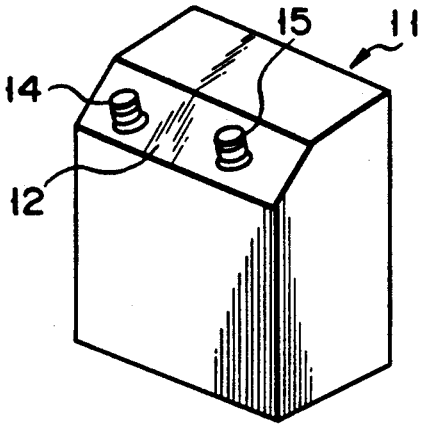
FIG. 5 is a view showing the outer appearance of a treating-liquid container according to another embodiment of the present invention.
Figure 6:
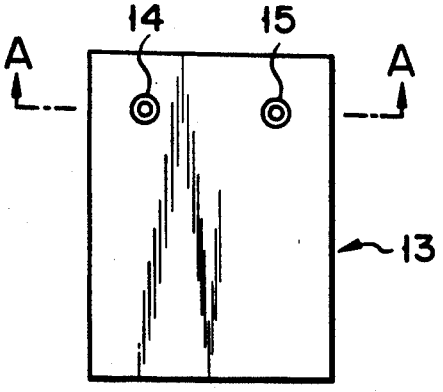
FIG. 6 is a view showing the outer appearance of an inner bag of FIG. 5.
Figure 7:
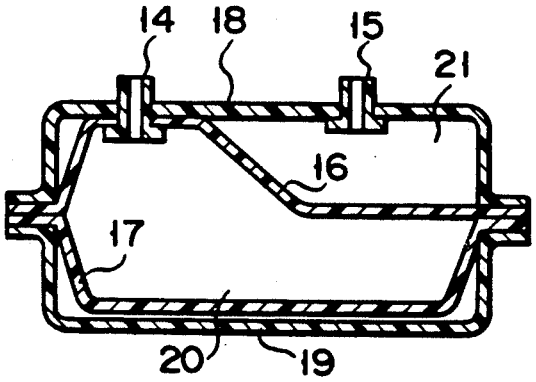
FIG. 7 is a cross-sectional view, taken along line A—A, showing the container of FIG. 5.

FIG. 5 is a view showing the outer appearance of a container according to another embodiment of the present invention. Like the first embodiment, outer rectangular box 11 is made of a rigid material, such as corrugated cardboard and has fixing section 12 about 45°-inclined at one corner side. Access ports 14 and 15 of inner bag 13 are fixed to fixing section 12. As is shown in FIGS. 6 and 7, inner bag 13 is made up of two main film sheets 16 and 17 and two buffer film sheets 18 and 19, which are made of, for example, polyethylene. The main and buffer sheets are overlappingly sealed at both ends. Access port 14 is provided at the main and buffer sheets in a manner to be fusion-bonded around the port to these sheets. Port 15 is provided at buffer films 18 in a manner to be fusion-bonded around the port to the buffer film 18. Main film 16 provides a partition wall whereby inner bag 13 is divided into two chambers, one of which serves as treating-liquid storage chamber 20 and the other as used-liquid storage chamber 21. Buffer films 18 and 19 should preferably be made of a material, such as polyethylene, whose pinholes are restricted to 1 or less in number under a Gelbofrex test (−10° C., 1500 times). Since a "blocking" phenomenon is liable to occur in those films having a low incidence of pin holes, the film should therefore be embossed.

In the container of the present invention, a treating liquid is held within the treating-liquid storage chamber at the time of use, with the used-liquid storage chamber remaining unoccupied. Thus the treating liquid is supported by such a double sheet film, and pinholes which would otherwise occur can be prevented from occurring at a bent portion (or portions) due to the buffering action of buffer films 18 and 19 on main films 16 and 17, respectively.

Figure 8:
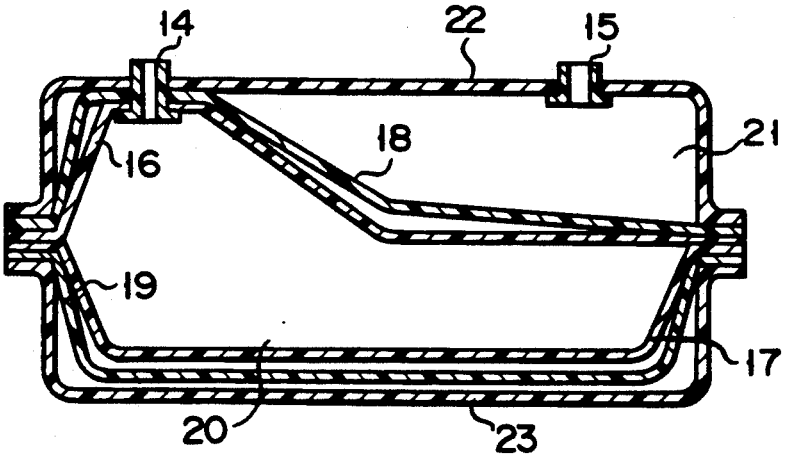
FIG. 8 is a cross-sectional view showing a variant of the container of FIG. 5.

In the case where the contents of the bag are a barrier property, the inner bag may be formed with a film of barrier property added thereto. In this case, if the outermost films are formed as films 22 and 23 of barrier property, access port 14 is fusion-bonded around the port to film 22, main film 16 and buffer film 18, and access port 15 is fusion-bonded around the port to film 22, as shown in FIG. 8, in which case a partition wall is defined by main film 16 and buffer film 18. Access port 15 is fusion-bonded around the port to film 22, with a partition wall defined by main film 16. Furthermore, films 22 and 23 may be formed as an intermediate film unit or the innermost film unit in place of using them as the outermost film unit. In this way, various forms may be selected according to the present invention.

In the container of the present invention, a treating liquid is initially held within the treating-liquid storage chamber, with the used-liquid storage chamber flattened or unoccupied. When, in these circumstances, the treating liquid is poured out of the treating-liquid storage chamber, that storage chamber correspondingly becomes flattened and simultaneously, a corresponding amount of used liquid enters the used-liquid storage chamber. The inner bag can be of a size that corresponds to the amount of treating liquid originally occupying the treating-liquid storage chamber. This allows the use of as compact a container as possible.

Thus, a smaller liquid storage space can be used for the treating liquid of a treating apparatus. Since the access ports are initially determined as "pour-in" or "pour-out" ports, inadvertent connection of the "pour-in" and pour-out ports can easily be prevented. Moreover, correct connection can be readily determined by each port being a different size.

Since the port fixing section of the container is about 45°-inclined on one corner side, the "pour-out" port can readily be connected to the associated apparatus.

Even if the inner bag becomes bent at places within the container, as a result of the container being oscillated during transportion, there is no risk of pinholes occurring at these bent portions, since the inner bag is protected and cushioned by the buffer film.

Furthermore, since it holds only one inner bag, the container of the present invention can be assembled more readily than its conventional counterparts.

What is claimed is:

1. A container for storing a treating liquid and for recovering a used treating liquid, which comprises: an outer box made of a substantially rigid material having a top wall portion and a fixing section at the top wall portion; and a flexible inner bag held within the outer box having a pair of access ports detachably connected to the fixing section of the outer box and a partition wall dividing the interior of the inner bag into a lower compartment defining a treating-liquid storage chamber and an upper compartment defining a used-liquid storage chamber, said storage chambers each having one of the pair of access ports for providing communication with an outer associated apparatus.

2. The container according to claim 1, wherein said access ports are different in size from each other.

3. The container according to claim 1, wherein each of said access ports is closed with a cover different in color from each other.

4. The container according to claim 1 further comprising a buffer film separately interposed between said inner bag and said partition wall for preventing pinholes from occurring in said inner bag.

5. The container according to claim 4, wherein said buffer film is an embossed film.

6. The container according to claim 4, wherein said buffer film is further covered from outside with a film having a barrier property.

7. The container according to claim 1 wherein the substantially rigid material is corrugated cardboard.

* * * * *